US006773096B2

(12) United States Patent
Mochizuki et al.

(10) Patent No.: US 6,773,096 B2
(45) Date of Patent: Aug. 10, 2004

(54) SUBSTRATE FOR RECORDING HEAD, RECORDING HEAD, RECORDING APPARATUS, AND METHOD OF INSPECTING SUBSTRATE FOR RECORDING HEAD

(75) Inventors: Muga Mochizuki, Kanagawa (JP); Ichiro Saito, Kanagawa (JP); Yoshiyuki Imanaka, Kanagawa (JP); Teruo Ozaki, Kanagawa (JP); Takaaki Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/290,531

(22) Filed: Nov. 8, 2002

(65) Prior Publication Data

US 2003/0090546 A1 May 15, 2003

(30) Foreign Application Priority Data

Nov. 15, 2001 (JP) ..... 2001-350265

(51) Int. Cl.[7] ..... B41J 2/065
(52) U.S. Cl. ..... 347/74; 347/23; 347/56
(58) Field of Search ..... 347/12, 40, 47, 347/56–59, 61, 74

(56) References Cited

U.S. PATENT DOCUMENTS 6,471,339 B1 * 10/2002 Kamiyama et al. ..... 347/61

FOREIGN PATENT DOCUMENTS

JP 411034380 A * 2/1999

* cited by examiner

*Primary Examiner*—Shih-Wen Hsieh
(74) *Attorney, Agent, or Firm*—Fitzpatrick, Cella, Harper & Scinto

(57) ABSTRACT

A substrate for a recording head includes a circuit through which current flows upon impression of a source voltage, irrespective of the operating state of an energy converting element, and a current cutoff means for cutting off current to the circuit in response to an entered control signal. A reset signal for achieving a standby state of the printing operation serves as the control signal. The current cutoff circuit is operated when the reset signal is active in an H state, and it cuts off the constant current. By cutting off the constant current, the leak current of a heater power source VH may be accurately measured, permitting determination of whether the source voltage wiring is properly insulated from other circuit elements of the substrate. The constant current may also be cut off in the standby state, in which printing is not performed, so as to reduce power consumption.

20 Claims, 14 Drawing Sheets

SUBSTRATE FOR RECORDING HEAD, RECORDING HEAD, RECORDING APPARATUS, AND METHOD OF INSPECTING SUBSTRATE FOR RECORDING HEAD

BACKGROUND OF THE INVENTION

1. Field of the Invention

The present invention relates to a recording head used as a recording head for conducting printing onto a recording medium, the recording head having an energy converting element for converting electric energy into printing energy, and a manufacturing method thereof. More particularly, the invention relates to a substrate for a recording head, which is a semiconductor substrate having a printing energy generating element for generating printing energy and a manufacturing method thereof.

In this specification, printing onto a recording medium shall include not only operations of printing of characters, but also printing operations of images other than characters such as symbols and graphics.

2. Description of the Related Art

There is conventionally known an ink-jet recording method called the bubble-jet recording method comprising the steps of causing a change in state in ink leading to a steep change in volume (occurrence of bubbles) by imparting energy such as heat to a liquid such as ink, discharging the ink from a discharge port under the effect of a working force resulting from the change in state, and forming an image by depositing the discharged ink onto a recording medium. A recording apparatus based on this bubble-jet recording method usually comprises, as disclosed in U.S. Pat. No. 4,723,129, a discharge port for discharging ink, an ink channel communicating with the discharge port, and a heating resistor serving as an energy converting element for discharging the ink, arranged in the ink channel.

According to such a recording method, it is possible to record a high-quality image at a high speed with low noise, and in a head carrying out this recording method, it is possible to arrange discharge ports for discharging ink at a high density. This recording method therefore provides many advantages including a recorded image of a high resolution available with a compact apparatus, and the possibility to easily obtain a color image. The bubble-jet recording method has therefore been popularly used in recent years in many office machines such as a printer, a copying machine and a facsimile machine, and the uses thereof now cover industrial systems including a textile printing apparatus.

A heating resistor for producing energy for discharging ink is manufacturable by means of a semiconductor manufacturing process. A conventional head based on the bubble-jet technology therefore has a configuration in which a covering plate made of a resin such as polysulfone or glass having a groove for forming an ink channel formed thereon is bonded onto an element substrate (a substrate for a recording head) comprising a silicon substrate having a heating resistor formed thereon.

In some such conventional heads, by use of the fact that the element substrate comprises a silicon substrate, in addition to the heating resistor formed on the element substrate, a driver for driving the heating resistor, a temperature sensor used when controlling the heating resistor in response to the head temperature, or a driving controller is arranged on the element substrate (Japanese Patent. Application Laid-Open No. 7-52387, etc.). A bead thus having a driver, a temperature sensor and a drive controller thereof has already been industrialized, contributing to improvement of reliability of recording heads and downsizing of apparatuses.

A configuration in which an element substrate 101 serving as a substrate for a recording head is arranged on a supporting plate 102 of the recording head is illustrated in FIG. 10. The element substrate 101 and a wiring substrate 105 are arranged on the recording head supporting plate 102, and the element substrate 101 and the wiring substrate 105 are bonded by wire bonding. A contact pad 106 for connecting to a printer main body is provided on the wiring substrate 105.

A configuration of the circuit element formed on the element substrate 101 is illustrated in a block diagram of FIG. 11. As shown in FIG. 11, a beater section 201, a driving circuit section 202, a retaining circuit section 203, a transfer circuit section 204, a voltage drop circuit section 905, a rank resistance measuring circuit section 906, and a temperature measuring circuit section 907 are formed on the element substrate 101.

The heater section 201 is composed of a plurality of heating resistors. The transfer circuit section 204 is composed of a shift register and the like, and converts serial data for printing into parallel data by sequentially transferring the same. The retaining circuit section 203 is a circuit for latching and retaining the parallel data converted by the transfer circuit section 204. The driving circuit section 202 individually drives the heating resistors of the heater section 201 on the basis of the data latched by the retaining circuit section 204. A reset signal 210 for achieving a standby state of a printing operation is entered in the retaining circuit section 203, and the retaining circuit section 203 outputs a data for prohibiting the driving circuit section 202 from operating when the reset signal 210 is active on a high level (hereinafter denoted as "H").

The voltage drop circuit section 905 is a circuit that outputs a voltage value of a beater driving power source VH by reducing the same by a certain value. The rank resistance measuring circuit section 906 is a circuit for measuring a resistance value of the rank resistance formed on the element substrate 101. The rank resistance as herein used is a resistance provided for measuring dispersion in manufacturing of the resistance values of the heating resistors formed in the heater section 201, provided separately from the other circuits, only for measuring resistance values. The temperature measuring circuit section 907 is for measuring temperature of an ink-jet head, being a sensor for measuring the ink temperature. Measurement of the ink temperature is based on the fact that the positive-direction voltage of a diode varies with temperature.

Typical circuit configurations of the voltage drop circuit section 905, the driving circuit section 202, and the heater section 201 are illustrated in FIG. 12.

The voltage drop circuit section 905 comprises resistances 21, 22 and 24, and an N-channel MOS transistor 23. The heater section 201 is composed of a plurality of heating resistors 50. In the driving circuit section 202, a resistance 25, N-channel MOS transistors 26 to 28 and a P-channel MOS transistor 29 are provided for one heating resistor 50 of the heater section 201.

The voltage drop circuit section 905 divides the entered heater power source VH by the resistances 21 and 22 into a certain voltage, and outputs a voltage lower than the thus divided voltage by a threshold value voltage of the N-channel MOS transistor 23. Because the heater power source VH has been divided by the resistances 21 and 22, a constant current to flows in the voltage drop circuit section 905, irrespective of the operating state of the recording head, i.e., the operating state of the heater serving as an energy converting element for converting electric energy into printing energy.

The driving circuit section 202 on/off-controls the N-channel MOS transistor 28 on the basis of data held in the retaining circuit section 203 and drives the heating resistors 50. The term "constant current" as herein used means a constant current flowing into circuits without being affected by the output state or the like, upon impression of the source voltage in a normal operating state. The constant current is used as a reference current in the above-mentioned circuits.

The voltage drop circuit section 905 for outputting the heater power source VH after reducing it by a prescribed value is provided for the following reasons.

Since the heater power source VH impressed onto the heating resistors 50 has a higher voltage than a logic power source VDD, the N-channel MOS transistor 28 is required to have a high driving capability for driving the heating resistors 50. It is, however, difficult to achieve a sufficient driving capability by directly impressing a logic signal of only the same voltage as the logic power source VDD for a gate of the N-channel MOS transistor 28. It is therefore necessary to impress a voltage higher than the logic power source VDD to the gate of the N-channel MOS transistor 28. For the purpose of controlling the N-channel MOS transistor 28 with the heater voltage VH, therefore, circuits such as a resistance 25, the N-channel MOS transistors 26 and 27 and a P-channel MOS transistor 29 are provided in the driving circuit section 202.

However, when the source withstanding voltage of all stages of P-channel MOS transistors of this N-channel MOS transistor 28 is lower than the voltage value of the heater power source VH, direct connection of the heater power source VH to the P-channel MOS transistor 29 would result in breakage of the P-channel MOS transistor 29. This is why the heater power source VH is reduced by a prescribed value by means of the voltage drop circuit section 905 and then impressed onto the source of the P-channel MOS transistor 29.

An example of the rank resistance measuring circuit section 906 is illustrated in FIG. 13. As shown in FIG. 13, the rank resistance measuring circuit section 906 comprises resistances 31 to 33, a rank resistance 34, and an operational amplifier 35. The logic power source VDD entered into the rank resistance measuring circuit section 906 is divided into the resistances 31 and 32, and entered into a non-reverse input terminal of the operational amplifier 35. The voltage value thereof is amplified by a gain based on the resistance values of the resistance 33 and the rank resistance 34 and output as an output voltage (RANK). If the resistance values of the resistances 31 to 33 are known, therefore, it is possible to determine a resistance value of the rank resistance 34 from this output voltage. The rank resistance measuring circuit section 906 also has a configuration in which constant current $I_0$ flows, irrespective of the operating state of the recording head, since the logic power source VDD is divided by the resistances 31 and 32.

A typical temperature measuring circuit section 907 is illustrated in FIG. 14. As shown in FIG. 14, the temperature measuring circuit section 907 comprises resistances 41 to 43, a diode temperature sensor 44, and an operational amplifier 45. The temperature measuring circuit section 907 has a circuit configuration in which the rank resistance 34 in the rank resistance measuring circuit section 906 shown in FIG. 13 is replaced by the diode temperature sensor 44. Temperature is measured by use of the fact that the positive-direction voltage of the diode temperature sensor varies with temperature. In the temperature measuring circuit section 907 also, in which the logic power source VDD is divided by the resistances 41 and 42, constant current $I_0$ flows, irrespective of the operating state of the recording head (that is, current flows even during non-operation of the heater which is the energy converting element for converting electric energy into printing energy).

In general, when manufacturing a substrate for a recording head comprising a semiconductor substrate as described above, an inspection is carried out to see whether or not insulation is ensured between the wiring for impressing the source voltage, including the logic power source VDD and the heater power source VH, and the other circuit elements. This inspection is carried out by confirming whether or not a leak current is produced through impression of a voltage to such source voltages as the logic power source VDD and the heater power source VH.

However, constant current as a reference current flows through the voltage drop circuit section 905, the rank resistance measuring circuit section 906, and the temperature measuring circuit section 907 described above immediately upon impressing source voltages such as the logic power source VDD and the heater power source VH.

As a result, along with the tendency toward forming not only the heating resistors but also various circuits on the element substrate, with improvement of functions of the ink-jet recording apparatus, it is impossible to accurately measure the leak current with the conventional recording head substrate when a circuit permitting flow of constant current is formed on the element substrate 101.

The aforementioned conventional substrate for a recording head therefore has a problem in that, when forming a circuit through which current flows, together with heating resistors, current is produced immediately upon impression of a source voltage such as a logic power source and a heater power source, and inspection of the operating state of the energy converting element is carried out along with impression of a voltage onto the head. It is therefore impossible to accurately measure the leak current.

An object of the present invention is therefore to provide a substrate for a recording head that, even during non-operation of the energy converting element, and even when a circuit allowing flow of constant current upon impression of voltage of the head is formed together with the heating resistors, permits accurate measurement of leak current.

SUMMARY OF THE INVENTION

To achieve the aforementioned object, the present invention provides a substrate for a recording head used as a recording head for conducting printing on a recording medium, having an energy converting element for converting electric energy into printing energy, and a circuit through which current flows upon impression of a source voltage, irrespective of the operating state of the energy converting element, wherein there is provided a current cutoff means for cutting off current to the circuit in response to an entered control signal.

According to the invention, when the control signal becomes active, the current cutoff circuit cuts off current in the circuit through which constant current flows upon impressing the source voltage. When measuring the leak current to see whether or not insulation is ensured between the wiring for the source voltage and the other circuit elements of the substrate for a recording head, the constant current is cut off by making the control signal active. In a normal operating state, the leak current can be accurately measured even when a circuit through which a constant current flows is formed, together with heating resistors, on the element substrate.

The above-mentioned control signal may be a reset signal for achieving a standby state of a printing operation.

According to the present invention, in a standby state of a recording apparatus in which a printing operation is not carried out, the reset signal becoming active causes the current cutoff circuit to operate, thereby permitting cutting off a part of the standby current (current consumed in standby state). It is thus possible to curtail the power consumption. In the invention, furthermore, the reset signal is used as a control signal for controlling the current cutoff circuit. It is therefore not necessary to increase the number of terminals for connecting the substrate for the recording head and the wiring substrate, and the current cutoff circuit can be provided without an increase in cost.

The reset signal may be pulled down or pulled up so that the reset signal becomes active when cut off from outside.

According to the invention, the reset signal is pulled up or pulled down so that the reset signal becomes active when the recording head is cut off from the recording apparatus. Therefore, even when connection between the recording head and the recording apparatus becomes defective or cut off, the reset signal becomes active, thus making it possible to prevent wrong printing.

According to another substrate for a recording head of the invention, the circuit through which current flows upon impression of a source voltage, irrespective of the operating state of the energy converting element, may be a voltage drop circuit for reducing the source voltage to a prescribed value, a rank resistance measuring circuit for measuring a resistance value of a rank resistance provided for measuring a dispersion of resistance values of heating resistors resulting from manufacture, or a temperature measuring circuit. The current cutoff means may be provided in the circuit through which current flows upon impression of a source voltage, irrespective of the operating state of the energy converting element.

The energy converting element for converting electric energy into printing energy may be an energy converting element for converting electric energy into discharge energy for discharging a liquid.

The recording head of the invention comprises any of the above-mentioned substrates for a recording head, and a wiring substrate connected to the substrate for the recording head via a bonding wire.

Furthermore, the recording head of the invention may comprise a plurality of discharge ports discharging a liquid, and members forming a plurality of liquid channels communicating with the discharge ports.

The recording apparatus of the invention comprises the above-mentioned recording head, driving signal supplying means which supplies to the recording head a driving signal for driving the recording head, and recording medium conveying means for conveying a recording medium onto which printing is performed by the recording head.

The invention provides an inspecting method of a substrate for a recording head for inspecting whether or not insulation is ensured between wiring of a source voltage and other circuit elements by use of the above-mentioned substrate for a recording head, comprising:

a step of impressing a source voltage, making a control signal active and making a signal for controlling other logical circuits inactive;

a step of measuring a current value of the current produced upon impressing a source voltage, irrespective of the state of operation of the energy converting element; and a step of, when the current value is a certain value or higher, determining that insulation is not ensured between wiring for impressing the source voltage and a circuit element which should normally not be connected thereto, and when the current value is lower than the certain value, determining that insulation is ensured between the wiring for impressing the source voltage and a circuit element which should normally not be connected thereto.

In the inspecting method of a substrate for a recording head of the invention, the control signal may be a reset signal for achieving a standby state of a printing operation.

Further objects, features and advantages of the present invention will become apparent from the following description of the preferred embodiments with reference to the attached drawings.

DESCRIPTION OF THE PREFERRED EMBODIMENTS

Figure 1:
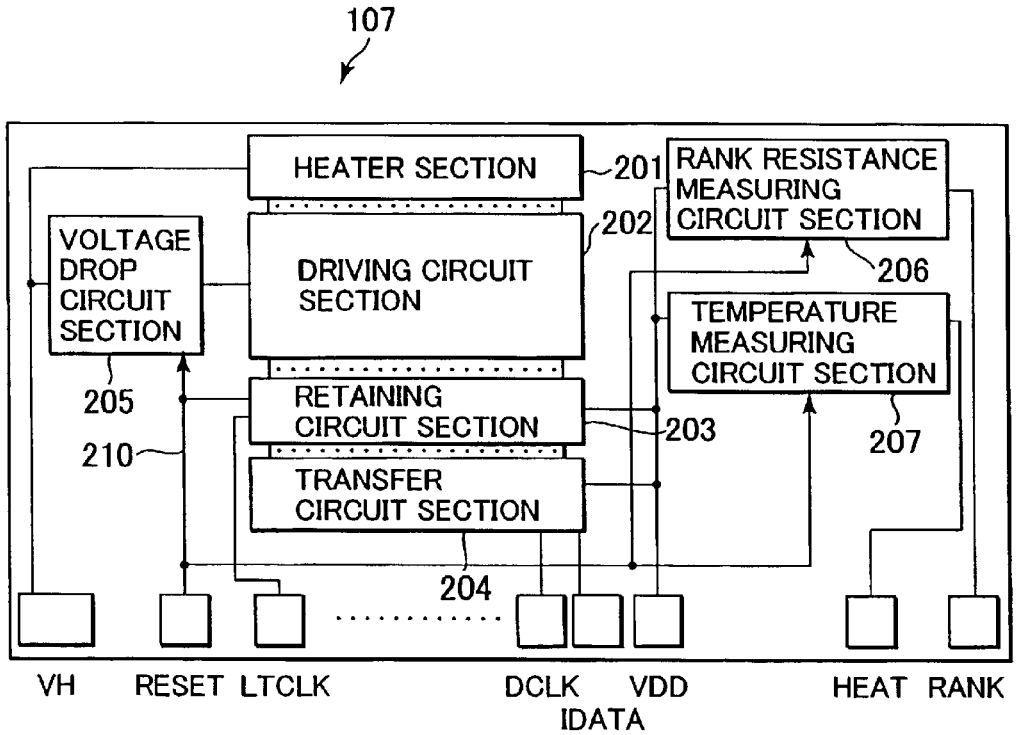
FIG. 1 is a block diagram illustrating the configuration of the substrate for the recording head of an embodiment of the present invention.

Embodiments of the present invention will now be described in detail with reference to the drawings. FIG. 1 is a block diagram illustrating the configuration of the substrate for a recording head of an embodiment of the invention. In FIG. 1, the same component elements as those in FIG. 11 are given the same reference numerals, and the description thereof is omitted.

Figure 11:
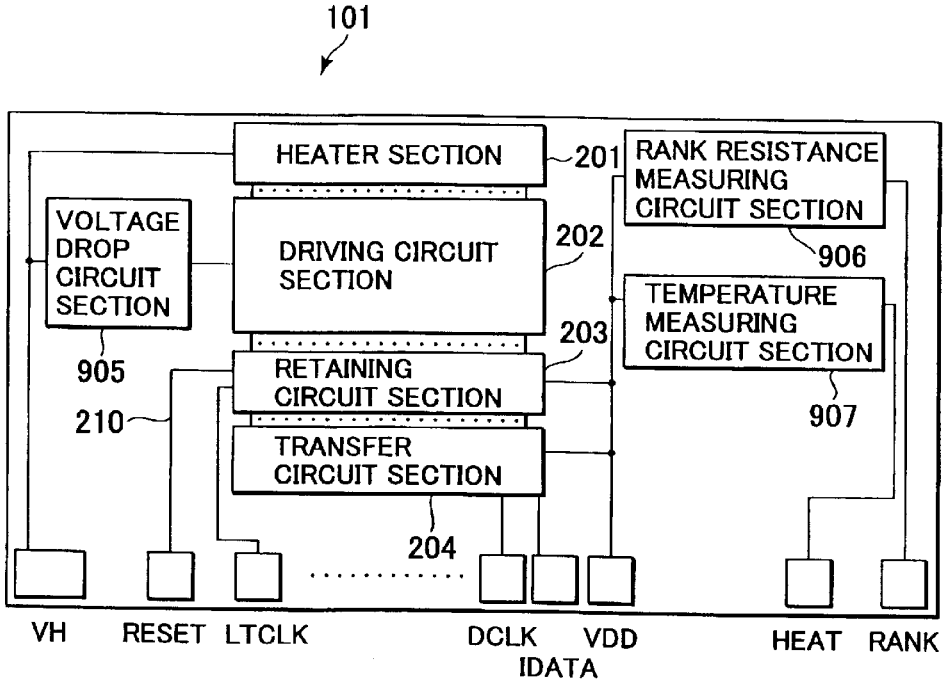
FIG. 11 is a block diagram illustrating the configuration of a conventional substrate for a recording head.

In the element substrate 107, which is the substrate for a recording head of this embodiment, the voltage drop circuit section 905, the rank resistance measuring circuit section 906 and the temperature measuring circuit section 907 in the element substrate 101, which is the conventional substrate for a recording head shown in FIG. 11, are replaced by a voltage drop circuit section 205, a rank resistance measuring circuit section 206, and a temperature measuring circuit section 207.

Figure 2:
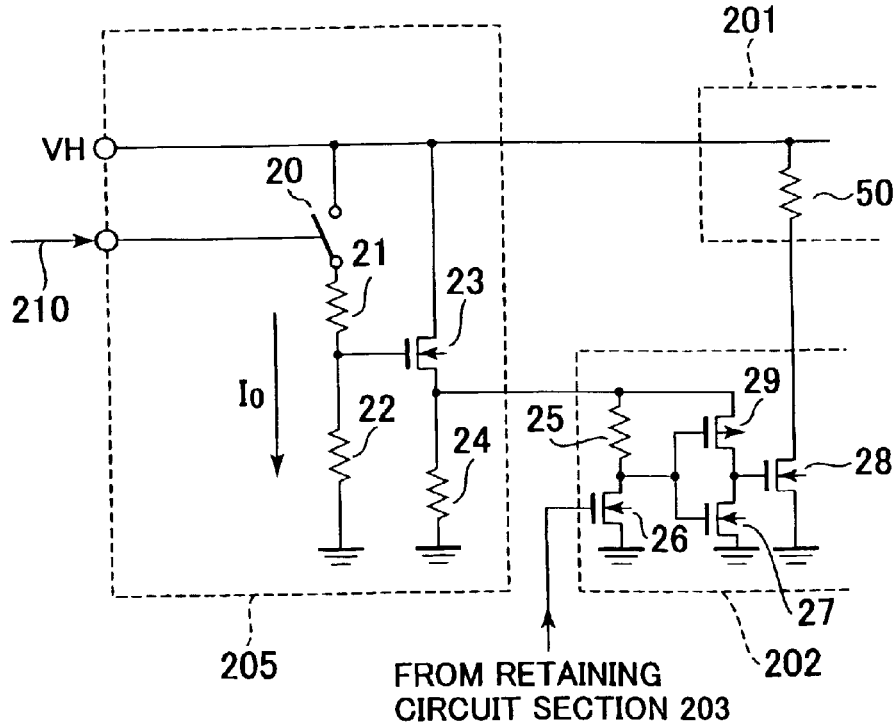
FIG. 2 is a circuit diagram illustrating the configuration of the voltage drop circuit section 205, the driving circuit section 202 and the heater section 201 shown in FIG. 1.
Figure 12:
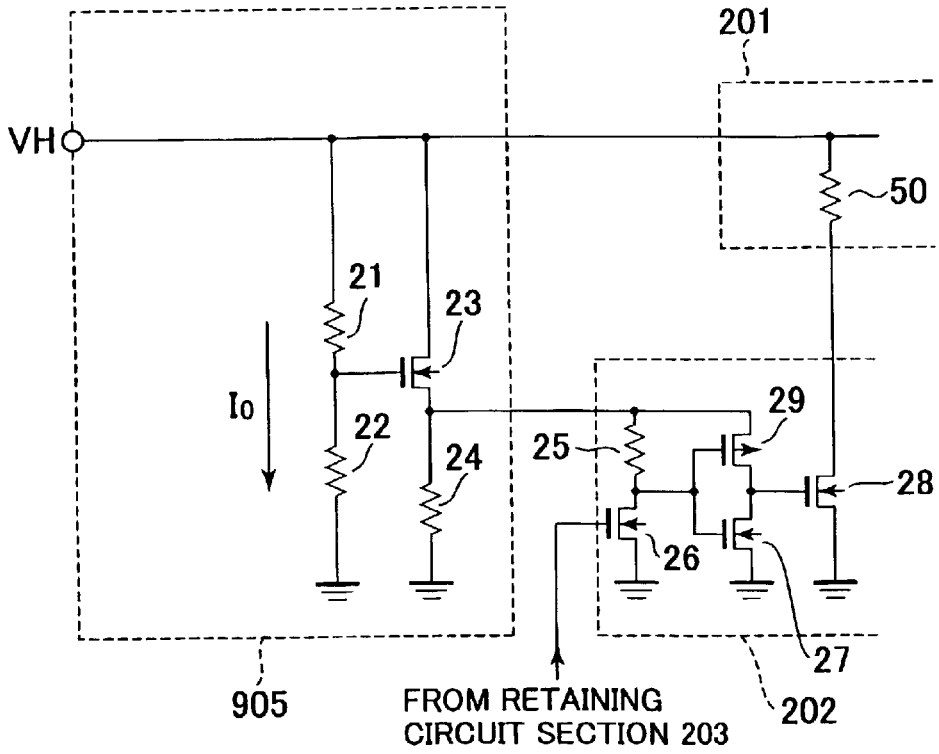
FIG. 12 illustrates a typical detailed circuit configuration of the voltage drop circuit section 905, the driving circuit section 202, and the heater section 201 shown in FIG. 11.

In the voltage drop circuit section 205, as shown in FIG. 2, a current cutoff circuit 20 is additionally provided between a heater power source VH and a resistance 21, as compared with the voltage drop circuit section 905 in the conventional substrate for a recording head shown in FIG. 12. The current cutoff circuit 20 is turned off when the reset signal 210 is inactive, i.e., L, and turned on when the reset signal 210 is active, i.e., H.

Figure 3:
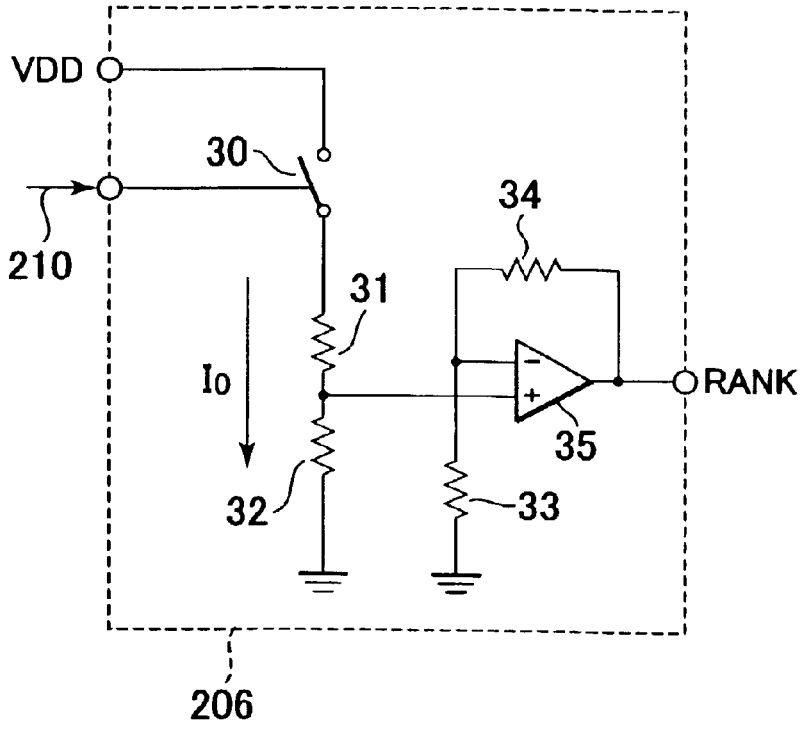
FIG. 3 is a circuit diagram illustrating the configuration of the rank resistance measuring circuit section 206 shown in FIG. 1.
Figure 13:
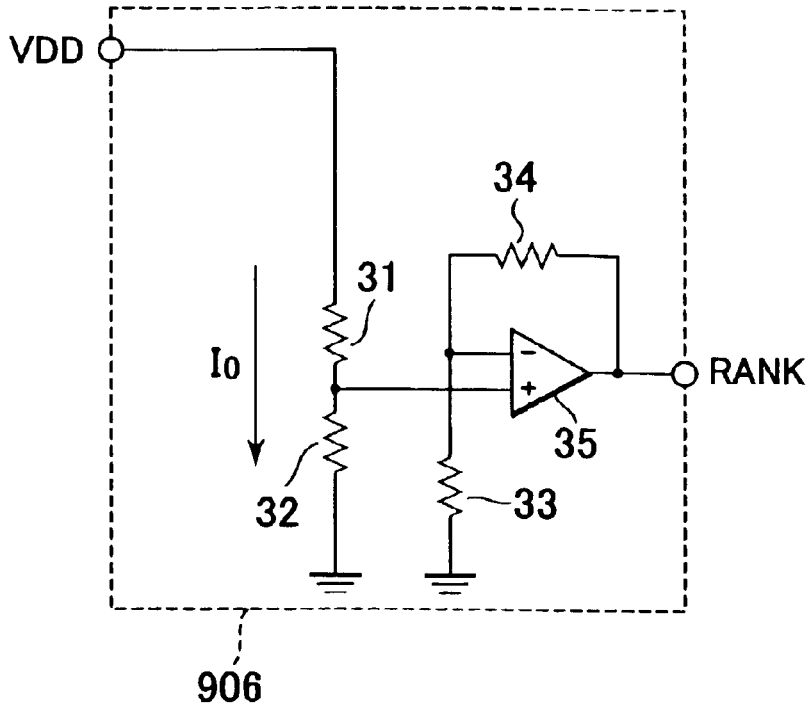
FIG. 13 is a circuit diagram illustrating the configuration of the rank resistance measuring circuit section 906 shown in FIG. 11.

In the rank resistance measuring circuit section 206, as shown in FIG. 3, a current cutoff circuit 30 is additionally provided between the logic power source VDD and the resistance 31 as compared with the rank resistance measuring circuit section 906 in the conventional substrate for a recording head shown in FIG. 13. The current cutoff circuit 30 is turned off when the reset signal 210 is inactive, i.e., L, and is turned on when the reset signal 210 is active, i.e., H.

Figure 4:
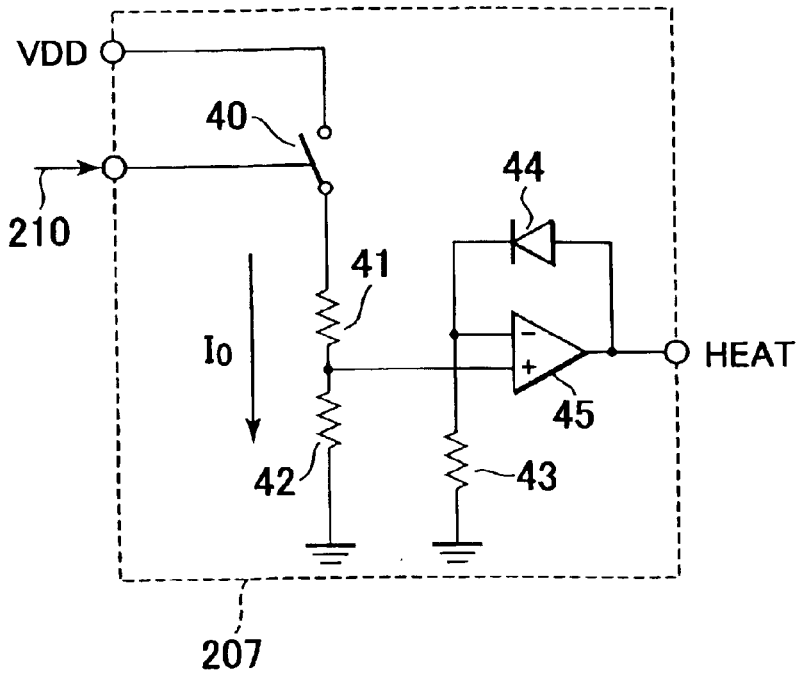
FIG. 4 is a circuit diagram illustrating the configuration of the temperature measuring circuit section 207 shown in FIG. 1.
Figure 14:
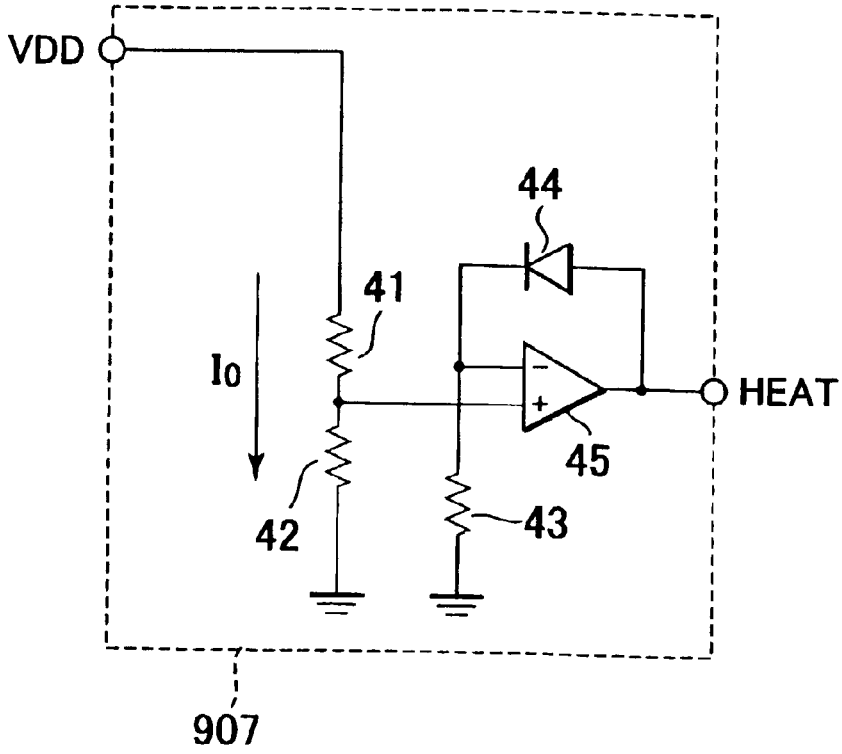
FIG. 14 is a circuit diagram illustrating the configuration of the temperature measuring circuit section 907 shown in FIG. 11.
Figure 6:
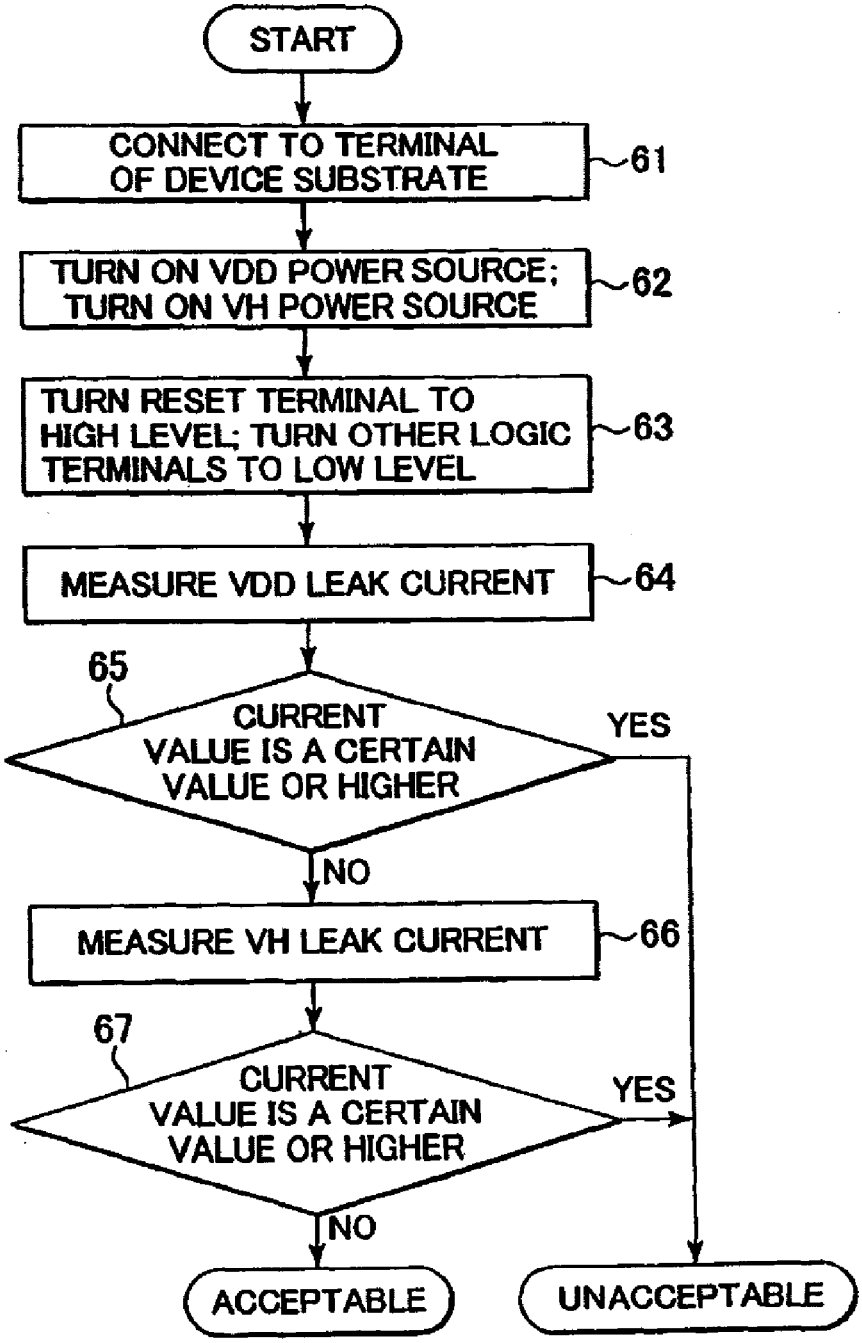

In the temperature measuring circuit section 207, as shown in FIG. 4, a current cutoff circuit 40 is additionally provided between the logic power source VDD and the resistance 41 as compared with the temperature measuring circuit section 907 in the conventional substrate for a recording head shown in FIG. 14. The current cutoff circuit 40 is turned off when the reset signal 210 is inactive, i.e., L, and is turned on when the reset signal 210 is active, i.e., H.

Figure 5:
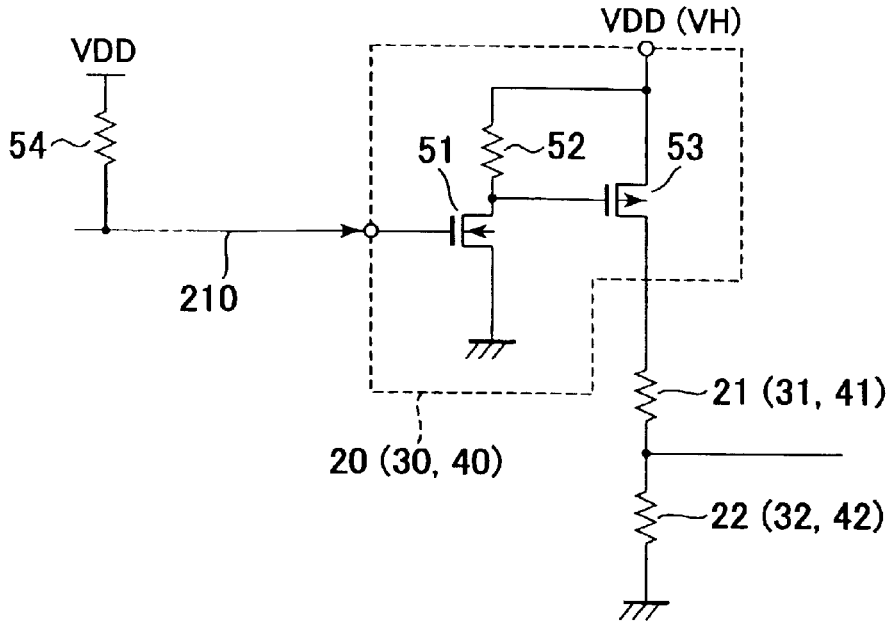
FIG. 5 is a typical detailed circuit diagram of the current cutoff circuit in a case where the reset signal 210 is in an active H state.

A typical detailed circuit of the current cutoff circuits 20, 30 and 40, as represented by the current cutoff circuit 20, is illustrated in FIG. 5. The current cutoff circuit 20 (30, 40) shown in FIG. 5 comprises an N-channel MOS transistor 51, a resistance 52, and a P-channel MOS transistor 53. The reset signal 210 is pulled up to the logic power source VDD by the pullup resistance 54 within the element substrate 107.

In the N-channel MOS transistor 51, the reset signal is impressed onto the gate. The source is connected to the ground potential, and the drain is connected to an end of the resistance 52. The other end of the resistance 52 is connected to the logic power source VDD (or the heater power source VH). In the P-channel MOS transistor 53, the gate is connected to the drain of the N-channel MOS transistor 51, and the source is connected to the logic power source VDD (or the heater power source VH). The drain is connected to the resistance 21 (31, 41).

In the current cutoff circuit 20 (30, 40), the N-channel MOS transistor 51 is turned on when the reset signal 210 becomes H, and the gate of the P-channel MOS transistor 53 becomes L. Accordingly, the P-channel MOS transistor 53 is turned off. The logic power source VDD (or the heater power source) is cut off from the resistance 21 (31, 41), and the flow of constant current is discontinued.

When the reset signal 210 becomes L, the N-channel MOS transistor 51 is turned off, and the gate of the P-channel MOS transistor 53 becomes H. As a result, the P-channel MOS transistor 53 is turned on. The logic power source VDD (or the heater power source) and the resistance 21 (31, 41) are connected, and constant current flows.

In the substrate for a recording head of this embodiment, when the reset signal 210 for achieving a standby state of a printing operation is active, i.e., H, the current cutoff circuits 20, 30 and 40 provided in the voltage drop circuit section 205, the rank resistance measuring circuit section 206 and the temperature measuring circuit section 207, respectively, are operated and the constant current is cut off. When measuring the leak current for carrying out an inspection to see whether or not insulation is ensured between the source voltage wiring and the other circuit elements, therefore, switching over the reset signal to H cuts off the constant current. Even when a circuit through which constant current flows in a usual operating state is formed, together with heating resistors, on the element substrate, it is possible to accurately measure the leak current.

In the standby state in which a printing operation is not performed in the recording apparatus, the reset signal 210 becomes active, and the constant current is cut off through operation of the current cutoff circuits 20, 30 and 40, thereby permitting reduction of the power consumption.

In this embodiment, furthermore, the reset signal 210 is employed as a control signal for controlling the current cutoff circuits 20, 30, 40 and 70. The current cutoff circuits 20, 30, 40 and 70 can therefore be provided without the need to increase the number of terminals for connecting the element substrate and the wiring substrate and without causing a cost increase. As a control signal for controlling the current cutoff circuits 20, 30, 40 and 70, however, a signal other than the reset signal 210 or a special signal may be used.

An inspecting method to see whether or not insulation is ensured between the source voltage wiring and the other circuit elements by means of the substrate for the recording head of this embodiment will now be described with reference to FIG. 6.

First, a circuit or an apparatus for inspection is connected to a terminal of an element substrate carrying out the inspection (step 61). Then, the logic power source VDD and the heater power source VH are turned on (step 62). At this moment when the reset signal 210 is still L, constant current flows.

The reset terminal is set to H, and the reset signal 210 is switched over to H, the other logic terminals being turned to L (step 63). These steps cut off the constant current. If insulation is ensured between the source voltage wiring and the other circuit elements which should not normally be connected, no leak current will be detected.

In this state, the leak current of the logic power source VDD is measured (step 64). If the measured current value is a certain value or higher, it is determined that insulation is not ensured between the logic power source VDD wiring and the circuit elements which should not normally be connected, and that the element substrate is unacceptable (step 65).

When no leak current is observed at all, or a measured value of leak current is lower than a certain value, the element substrate is determined to be acceptable, and leak current of the heater power source VH is measured (step 66). If the measured current value is a certain value or higher, it is determined that insulation is not ensured between the heater power source VH wiring and the circuit elements which should not normally be connected, and it is determined that the element substrate is unaccepable (step 67).

When no leak current is observed at all or when the measured leak current is lower than a certain value in step 67, it is determined that the element substrate is finally an acceptable product.

The above description has covered a case where the reset signal 210 is active in the H state. The present invention is not, however, limited to such a case, but is similarly applicable also in a case where the reset signal 210 is active in the L state. In this case, it suffices to use a current cutoff circuit 70 as shown in FIG. 7, which cuts off the constant current when the reset signal is active in the L state, in place of the current cutoff circuits 20, 30 and 40.

Figure 7:
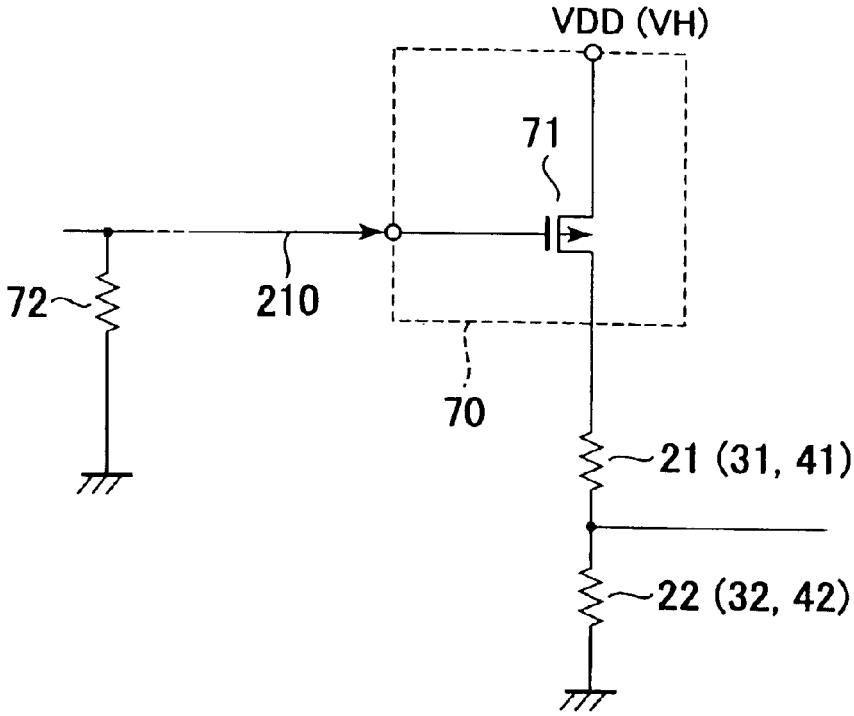
FIG. 7 is a typical detailed circuit diagram of the current cutoff circuit in a case where the reset signal 210 is in an active L state.

The current cutoff circuit 70 comprises a P-channel MOS transistor 71, as shown in FIG. 7, in which the signal 210 is impressed onto the gate, the source being connected to the logic power source VDD, and the drain is connected to the resistance 21 (31, 41). In such a case, the reset signal 210 is pulled down to the ground potential by a pulldown resistance 72 within the element substrate.

The current cutoff circuits 20, 30, 40 and 70 are not limited to circuits shown in FIGS. 5 and 7, but may have any other circuit configuration in which constant current is cut off in a logical state in which the reset signal 210 is active.

In this embodiment, furthermore, the reset signal 210 is pulled up or pulled down when the recording head is removed from the recording apparatus so that the reset signal becomes active. Even when the connection between the ink-jet recording head and the ink-jet recording apparatus becomes defective or cut off for some reason, therefore, the reset signal 210 still becomes active, thereby preventing wrong printing.

Figure 8:
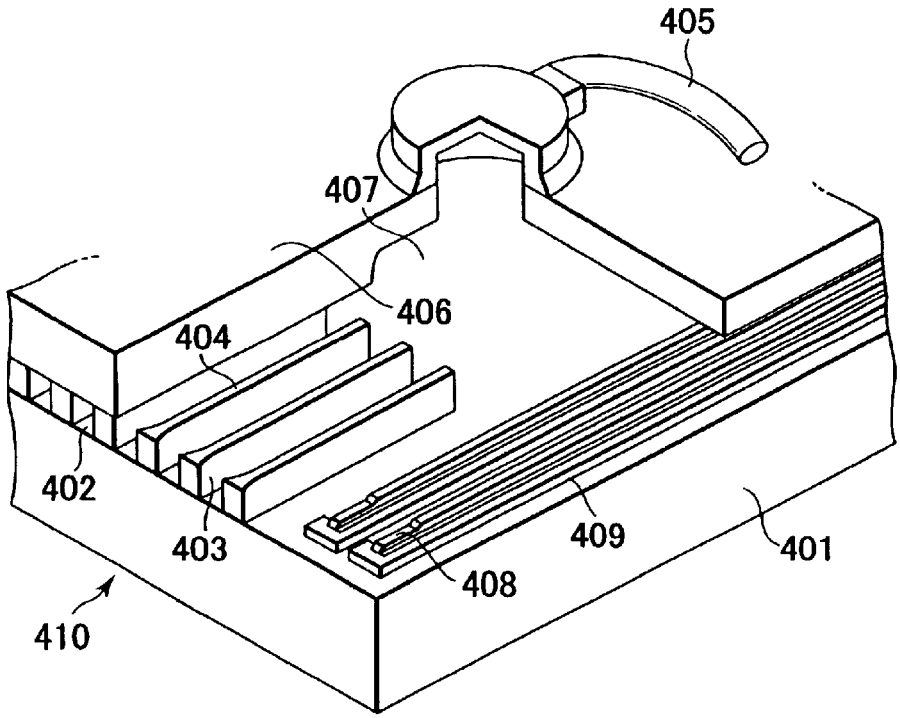
FIG. 8 illustrates a typical configuration of the ink-jet recording head using the substrate for the recording head of the invention.

A typical ink-jet recording head, which is a recording head using a substrate for a recording head having the configuration as described above, is illustrated in FIG. 8. As shown in FIG. 8, channel wall members 404 for forming liquid channels 403 communicating with a plurality of discharge ports 402 and a ceiling plate 406 having an ink feeding port 405 are attached to the substrate 401 for the recording head. The liquid channels 403 and the ink feeding port 405 communicate with each other via a common liquid chamber 407. A heating section 408 near the discharge port 402 provided on the substrate 401 and wiring 409 to the heating section 408 are arranged in each liquid channel 403. In the recording head 410 of the ink-jet recording type having the above-mentioned configuration, the ink injected from the ink feeding port 405 is stored in the common liquid chamber 407 in the interior, and supplied to the individual liquid channels 403. Ink discharge is performed from the discharge port 402 by driving the heating sections 408 of the substrate 401 in this state.

The above description has covered a case where the ceiling plate 406 and the channel wall members 404 are made of different members. However, the ceiling plate 406 and the channel wall members 404 may be an integrally formed single member.

An ink-jet recording apparatus permitting high-speed recording and high-image-quality recording is available by attaching the above-mentioned recording head 410 to the recording apparatus main body and giving a signal from the apparatus main body to the recording head 410.

An outline of the recording apparatus mounting the above-mentioned recording head will now be described.

Figure 9:
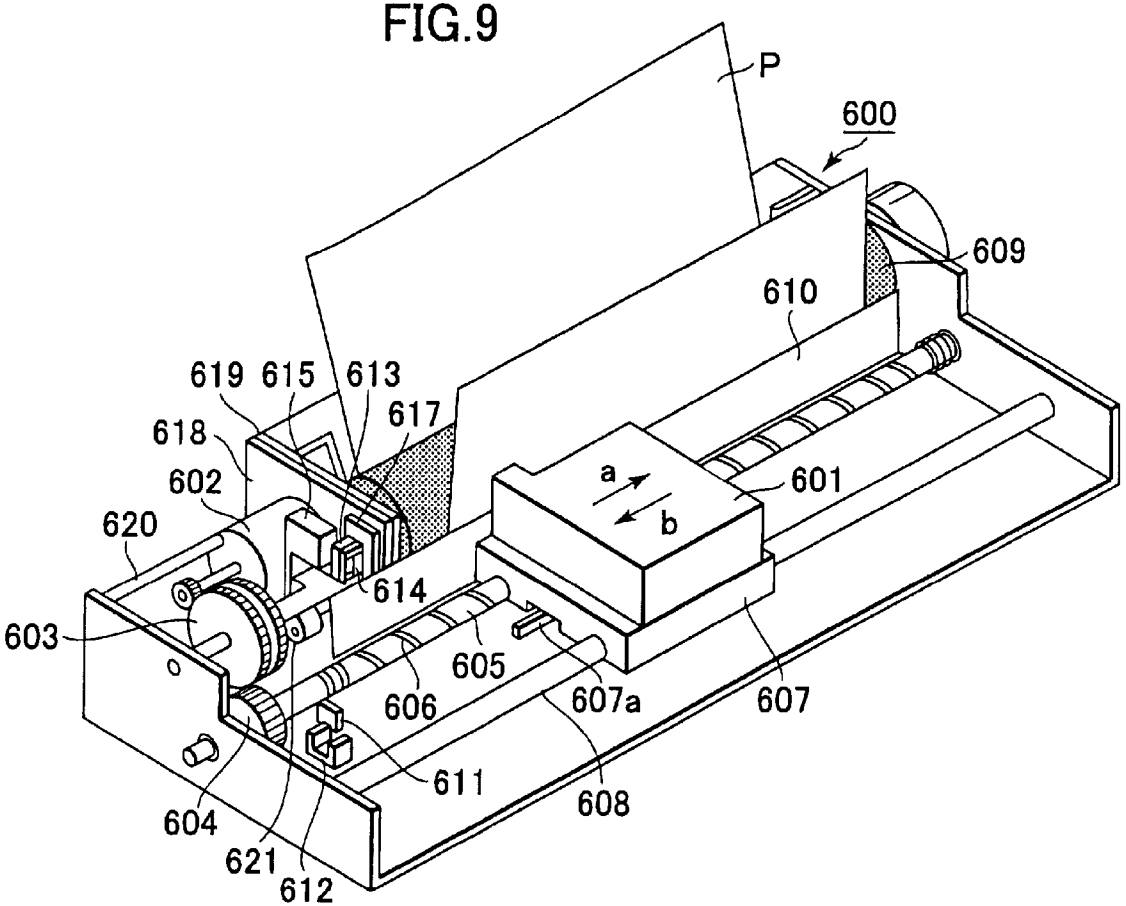
FIG. 9 is a schematic perspective view of the ink-jet recording apparatus applicable by attaching thereto the recording head of the invention.
Figure 10:
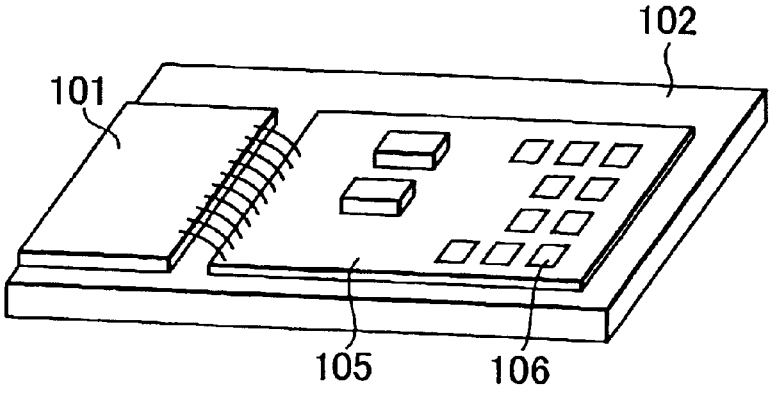
FIG. 10 illustrates the configuration in which an element substrate is arranged on the supporting plate 102 of the recording head.

FIG. 9 is a schematic perspective view of an ink-jet recording apparatus, which is a recording apparatus to which the recording head of the present invention is applicable by attaching the same thereto.

In FIG. 9, an ink-jet head cartridge 601 is composed of the above-mentioned recording head and an ink tank holding ink to be fed to this recording head integrally combined. This ink-jet head cartridge 601 is mounted on a carriage 607 engaging with a spiral groove 606 of a lead screw 605 rotating, via driving force transmitting gears 603 and 604, in linkage with positive and negative rotation of a driving motor 602, and is reciprocally driven in the direction of the arrows a-b along a guide 608, together with the carriage, by the driving force of the driving motor 602. The recording medium P is conveyed on a platen roller 609 by recording medium conveying means not shown, and pressed against the platen roller 609 opposite the carriage 607 in the conveying direction of the carriage 607 by a paper pressing plate 610.

Photocouplers 611 and 612 are arranged near an end of the lead screw 605. These photocouplers 611 and 612 are home position detecting means for switching over the rotating direction of the driving motor 602 by confirming the presence of a lever 607*a* of the carriage 607 within this area.

A supporting member 613 supports a cap member 614 which covers the front side containing the discharge port (discharge port side) of the above-mentioned ink-jet head cartridge 601. Ink sucking means 615 sucks the ink accumulated in the interior of the cap member 614 as a result of blank discharge from the ink-jet head cartridge 601. Suction-recovery of the ink-jet head cartridge 601 by the ink sucking means 615 occurs via a cap inner opening. A cleaning blade 617 for wiping off the discharge port side of the ink-jet head cartridge 601 is provided movably in the front-back direction (a direction perpendicular to the moving direction of the carriage 607) by a moving member 618. The cleaning blade 617 and the moving member 618 are supported by a main body support 619. The cleaning blade 617 is not limited to this shape, but may be any other known cleaning blade.

A lever 620 for causing start of suction when performing a suction recovering operation of the recording head moves with the movement of a cam 621 engaging with the carriage 607. The driving force from the driving motor 602 is movement-controlled by known transmission means such as clutch change-over. An ink-jet recording controller, not shown, which issues a signal to the heating member provided on the recording head of the ink-jet head cartridge 601, and governs driving control of the aforementioned mechanism, is provided on the apparatus main body side.

In the ink-jet recording apparatus 600 having the above-mentioned configuration, the ink-jet head cartridge 601 performs recording by depositing the ink onto the recording medium P while reciprocating over the entire width of the recording medium P conveyed on the platen roller 609 by use of the recording medium conveying means not shown. The ink-jet recording apparatus 600 has driving signal supplying means not shown supplying a driving signal for causing the recording head to discharge the ink.

The above description has covered a case where a heating resistor imparting energy such as heat to the ink is used to serve as an energy converting element for converting electric energy into discharge energy for discharging the ink. The present invention is similarly applicable when a piezoelectric element is used as an energy converting element for converting electric energy into discharge energy for discharging the ink.

The above description has covered a case where an element substrate which is a semiconductor substrate is adopted for an ink-jet type recovery head. The present invention is applicable also, for example, to a substrate for a thermal head.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A substrate for a recording head used for conducting printing on a recording medium, comprising an energy converting element for converting electric energy into printing energy, and a circuit through which current flows upon impression of a source voltage, irrespective of the operating state of said energy converting element, wherein a current cutoff means is provided for cutting off current to said circuit in response to an entered control signal.

2. A substrate for a recording head according to claim 1, wherein the control signal is a reset signal for achieving a standby state of a printing operation.

3. A substrate for a recording head according to claim 2, wherein the reset signal is pulled down or pulled up so that the reset signal becomes active when the recording head is cut off from outside.

4. A substrate for a recording head according to claim 2, wherein said circuit through which current flows upon impression of a source voltage comprises a voltage drop circuit, a rank resistance measuring circuit, and a temperature measuring circuit, and wherein the reset signal controls said current cutoff means.

5. A substrate for a recording head according to claim 1, wherein said circuit through which current flows upon impression of a source voltage is a voltage drop circuit for reducing the source voltage to a prescribed value.

6. A substrate for a recording head according to claim 1, wherein said circuit through which current flows upon impression of a source voltage is a rank resistance measuring circuit for measuring a resistance value of a rank resistance provided for measuring a dispersion of resistance values of heating resistors.

7. A substrate for a recording head according to claim 1, wherein said circuit through which current flows upon impression of a source voltage is a temperature measuring circuit.

8. A substrate for a recording head according to claim 1, wherein said current cutoff means is provided in said circuit through which current flows upon impression of a source voltage.

9. A substrate for a recording head according to claim 8, wherein said current cutoff means comprises a P-channel MOS transistor.

10. A substrate for a recording head according to claim 8, wherein said current cutoff means comprises an N-channel MOS transistor, a resistance, and a P-channel MOS transistor.

11. A substrate for a recording head according to claim 1, wherein said energy converting element for converting electric energy into printing energy is an energy converting element for converting electric energy into discharge energy for discharging a liquid.

12. A substrate for a recording head according to claim 11, wherein said energy converting element is a heating resistor.

13. A substrate for a recording head according to claim 11, wherein said energy converting element is a piezoelectric element.

14. A recording head comprising a substrate for a recording head according to claim 1, and a wiring substrate connected to said substrate for a recording head via a bonding wire.

15. A recording head according to claim 14, further comprising a plurality of discharge ports for discharging a liquid, and members forming a plurality of liquid channels communicating with said discharge ports.

16. A recording apparatus comprising a recording head according to claim 14, driving signal supplying means which supplies to said recording head a driving signal for driving said recording head, and recording medium conveying means for conveying a recording medium onto which printing is performed by said recording head.

17. An method of inspecting a substrate for a recording head for determining whether or not insulation obtains between wiring of a source voltage and other circuit elements, by use of the substrate for a recording head according to claim 1, comprising:

a step of impressing the source voltage, making the control signal active and making a signal for controlling other logical circuits inactive;

a step of measuring an amount of current produced upon impressing the source voltage, irrespective of the state of operation of the energy converting element; and a step of, when the amount of current is a certain amount or greater, determining that insulation does not obtain between wiring for impressing the source voltage and a circuit element which should normally not be connected thereto, and when the amount of current is less than the certain amount, determining that insulation obtains between the wiring for impressing the source voltage and a circuit element which should normally not be connected thereto.

18. An method of inspecting a substrate for a recording head according to claim 17, wherein the control signal is a reset signal for achieving a standby state of a printing operation.

19. An method of inspecting a substrate for a recording head according to claim 17, wherein said measuring step and said determining step are performed twice, once for measuring a leak current of a logic power source and making the determination in said determining step based on the measured amount of the leak current of the logic power source, and once for measuring a leak current of a heater power source and making the determination in said determining step based on the measured amount of the leak current of the heater power source.

20. A substrate for a recording head according to claim 1, wherein said circuit through which current flows upon impression of a source voltage comprises a voltage drop circuit, a rank resistance measuring circuit, and a temperature measuring circuit.

* * * * *

UNITED STATES PATENT AND TRADEMARK OFFICE

CERTIFICATE OF CORRECTION

PATENT NO. : 6,773,096 B2
DATED : August 10, 2004
INVENTOR(S) : Muga Mochizuki et al.

Figure 6:
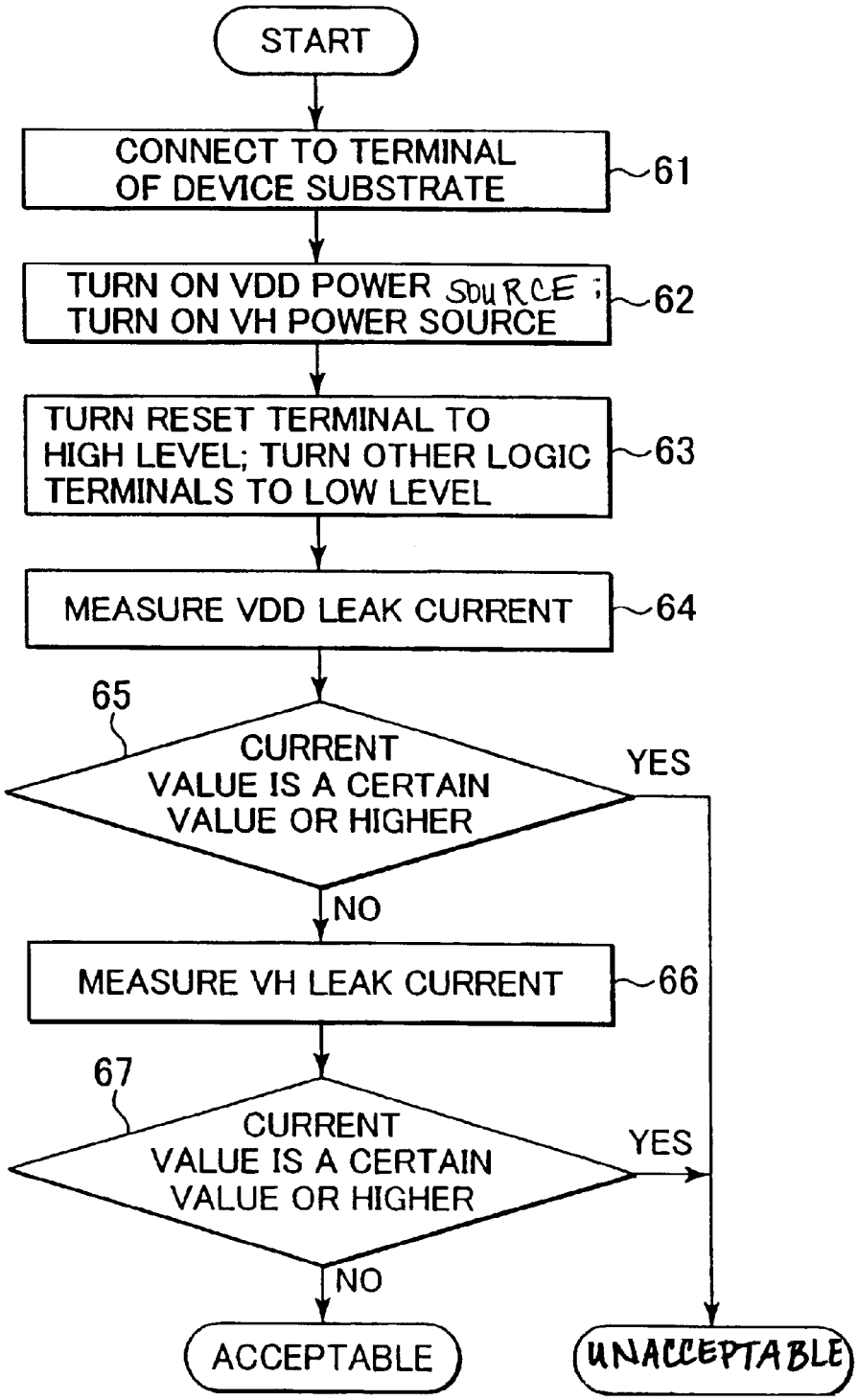
FIG. 6 is a flowchart illustrating the inspection method.

It is certified that error appears in the above-identified patent and that said Letters Patent is hereby corrected as shown below:

Delete Drawing Sheet 6 and substitute therefor the Drawing Sheet consisting of FIG 6 as shown on attached page Column 2,
Line 2, “bead” should read -- head --; and
Lines 17 and 39, “beater” should read -- heater --.

Column 3,
Line 3, “to flows” should read -- $I_0$ flows --.

Column 12,
Lines 22, 43 and 47, “An” should read -- A --.

Signed and Sealed this

Twelfth Day of July, 2005

JON W. DUDAS
*Director of the United States Patent and Trademark Office*